US007434334B2

(12) United States Patent
Hwang et al.

(10) Patent No.: US 7,434,334 B2
(45) Date of Patent: Oct. 14, 2008

(54) DRYER WITH BACK COVER FIRST AND SECOND TAB LATCHES

(75) Inventors: Sung Gi Hwang, Changwon-si (KR); Il Tak Han, Suwon (KR); Jeung Gie Ahn, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/888,974

(22) Filed: Jul. 13, 2004

(65) Prior Publication Data

US 2005/0108893 A1 May 26, 2005

(30) Foreign Application Priority Data

Nov. 26, 2003 (KR) ..... P 10-2003-0084558

(51) Int. Cl.
*F26B 11/02* (2006.01)

(52) U.S. Cl. ..... 34/606; 68/139; 248/343

(58) Field of Classification Search ..... 34/602, 34/603, 606; 68/142, 239, 139; 248/314, 248/343, 231.9; 312/263, 265.5, 222; 49/463
See application file for complete search history.

(56) References Cited

U.S. PATENT DOCUMENTS 2,389,774 A * 11/1945 Haberstump ..... 220/4.02
3,309,783 A * 3/1967 Worst ..... 34/553
3,402,576 A * 9/1968 Krupsky ..... 68/4
4,207,686 A * 6/1980 Daily ..... 34/610
4,430,809 A * 2/1984 Jackson et al. ..... 34/601
4,618,193 A * 10/1986 Cuthbert et al. ..... 312/264
5,066,050 A * 11/1991 Kretchman ..... 285/319
5,127,169 A * 7/1992 Ellingson ..... 34/601
5,216,823 A * 6/1993 Ripley ..... 34/601
5,221,069 A * 6/1993 Struthers et al. ..... 248/231.9
5,257,448 A * 11/1993 Pearce et al. ..... 29/434
5,257,468 A * 11/1993 Lebrun ..... 34/235
5,513,909 A * 5/1996 Teich ..... 312/351.6
5,546,678 A * 8/1996 Dhaemers ..... 34/275
6,343,492 B1 * 2/2002 Seagar et al. ..... 68/142
6,481,035 B2 * 11/2002 Seagar et al. ..... 8/159

* cited by examiner

*Primary Examiner*—S. Gravini
(74) *Attorney, Agent, or Firm*—McKenna Long & Aldridge LLP

(57) ABSTRACT

The present invention provides a dryer, by which a simpler assembly between a rear supporter and a back cover is provided. The dryer includes a back cover covering a rear side of the dryer, a drum containing a laundry and rotating to dry the laundry, a rear supporter supporting a rear side of the drum, and at least one latching part provided to an upper side of the back cover to latch an upper edge of the rear supporter.

30 Claims, 4 Drawing Sheets

DRYER WITH BACK COVER FIRST AND SECOND TAB LATCHES

This application claims the benefit of Korean Applications No. P2003-084558, filed on Nov. 26, 2003, which is hereby incorporated by reference.

BACKGROUND OF THE INVENTION

1. Field of the Invention

The present invention relates to a dryer, in which a more stable assembly between a rear supporter and a back cover is achieved.

2. Discussion of the Related Art

Generally, a dryer is an apparatus for drying a wet object such as clothes, laundry, linen, and so on after completion of washing. A general structure of the dryer is explained as follows.

FIG. 1 is a perspective diagram of a dryer according to a related art. Referring to FIG. 1, an outer case 10 of a dryer consists of a front cabinet 20, a side cabinet 30, a back cover 100, a top plate 40, and a control panel 50. And, a front cabinet 20 is provided to a front side of the dryer. An opening is provided to the front cabinet 20 so that a laundry is put inside the dryer via the opening, and a door 22 is installed over the opening.

The side cabinet 30 and the back cover 100 are provided to lateral sides and a rear side of the dryer, respectively. The top plate 40 is provided over the dryer, and the control panel 50 is provided in front of the control panel 50.

A drum is rotatably provided within the outer case 10 to contain a laundry therein to be rotated by receiving a drive force of a motor. And, both ends of the drum are supported by front and supporters, respectively.

However, the related art rear supporter is coupled to a rear end of the drum via screw or the like, thereby causing inconvenience of work.

SUMMARY OF THE INVENTION

Accordingly, the present invention is directed to a dryer that substantially obviates one or more of the problems due to limitations and disadvantages of the related art.

An object of the present invention, which has been devised to solve the foregoing problem, is to provide a dryer, by which a simpler assembly between a rear supporter and a back cover is provided to a laundry dryer.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, a dryer includes a back cover covering a rear side of the dryer, a drum containing a laundry and rotating to dry the laundry, a rear supporter supporting a rear side of the drum, and at least one latching part provided to an upper side of the back cover to latch an upper edge of the rear supporter.

Preferably, the latching part includes a first tab cut out from one side of the back cover to have a channel shape and being bent forward, and a second tab cut out from a portion of the first tab to have a reverse channel shape, the second tab bent downward to latch the upper edge of the rear supporter.

In this case, guide grooves are formed on portions where the first and second tabs are bent, respectively, to guide bending thereon. And, the first and second tabs are formed by lancing a portion of the back cover.

Meanwhile, the latching part may include a first tab cut out from one side of the back cover to have a reverse channel shape and being bent forward, and a second tab cut out from a portion of the first tab to have a channel shape, the second tab bent upward to latch the upper edge of the rear supporter.

In this case, guide grooves are formed on portions where the first and second tabs are bent, respectively, to guide bending thereon. The first and second tabs are formed by lancing a portion of the back cover. And, a stepping part is provided to the back cover to support a lower end portion of the rear supporter.

Preferably, a recess recessed backward is provided to the back cover to have the rear supporter inserted therein. And, the at least two latching parts are included two or more equally-shaped latching parts.

In another aspect of the present invention, a dryer includes a drum containing a laundry and rotating to dry the laundry, a rear supporter supporting a rear side of the drum, and a back cover including at least one latching part provided to an upper side of the back cover to latch an upper edge of the rear supporter, and a stepping part provided to a lower side of the back cover to support a lower end portion of the rear supporter.

The latching part includes a first tab cut out from one side of the back cover to have a channel shape and being bent forward, and a second tab cut out from a portion of the first cut-off part to have a reverse channel shape and being bent downward to latch the upper edge of the rear supporter.

In this case, guide grooves are formed on portions where the first and second tabs are bent, respectively, to guide bending thereon. And, the first and second tabs are formed by lancing a portion of the back cover.

Meanwhile, the latching part may include a first tab cut out from one side of the back cover to have a reverse channel shape and being bent forward, and a second tab being cut off from a portion of the first tab to have a channel shape, the second tab being bent upward to latch the upper edge of the rear supporter.

In this case, guide grooves are formed on portions where the first and second tabs are bent, respectively, to guide bending thereon. And, the first and second tabs are formed by lancing a portion of the back cover.

Preferably, a recess recessed backward is provided to the back cover to have the rear supporter inserted therein. And, the at least two latching parts includes two or more equally-shaped latching parts.

In a further aspect of the present invention, a dryer includes a drum containing a laundry and rotating to dry the laundry, a rear supporter including a support plate and a projected from the support plate to be inserted in a rear end of the drum, and a back cover including a latching part, the latching part including a first tab cut out from one side of the back cover to have a channel shape and being bent forward and a second tab cut out from a portion of the first tab to have a reverse channel shape and being bent downward to latch an upper edge of the rear supporter.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings. Throughout the drawings, like elements are indicated using the same or similar reference designations where possible.

Figure 2:
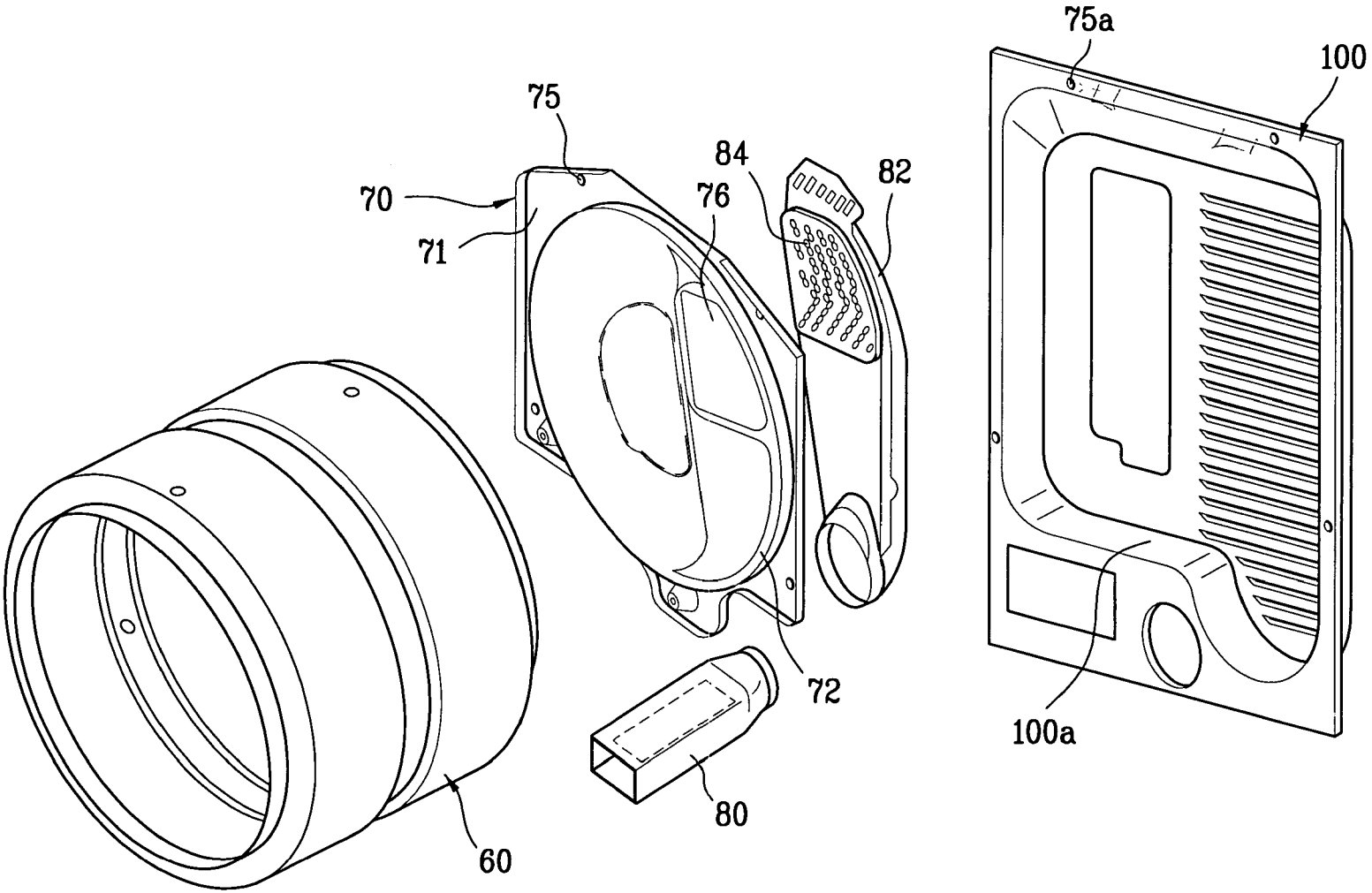
FIG. 2 is a perspective view of an assembly of a back cover and rear supporter of a dryer.

FIG. 2 is a perspective view of an assembly of a back cover and rear supporter of a dryer. Referring to FIG. 2, a drum 60 is rotatably provided within a dryer. And, a heater 80 heating air to make hot and dry is provided under the drum 60. A rear end of the drum 60 is supported by a rear supporter 70 that is assembled to a back cover 100.

The rear supporter 70 includes a support plate 71 and a projected part 72. The projected part 72 having a circular shape is provided to a front side of the support plate 71 to fit a rim of the drum 60. The projected part 72 is inserted in a rear side of the drum 60 to be fixed thereto. Locking holes 75 and 75*a* are formed at the support plate 71 and the back cover 100 to correspond to each other, whereby a screw is fitted into the locking holes 75 and 75*a*. Hence, the rear supporter 70 is fixed to the back cover 100 as well as supports the rear side of the drum 60.

A portion 76 of a rear side of the rear supporter 70 is open so that the hot and dry air generated from the heater 80 can be supplied inside the drum 60. The open portion 76 communicates with the heater 80 via an air duct 82. And, a multitude of holes 84 are provided to an entrance of the air duct 82.

Figure 1:
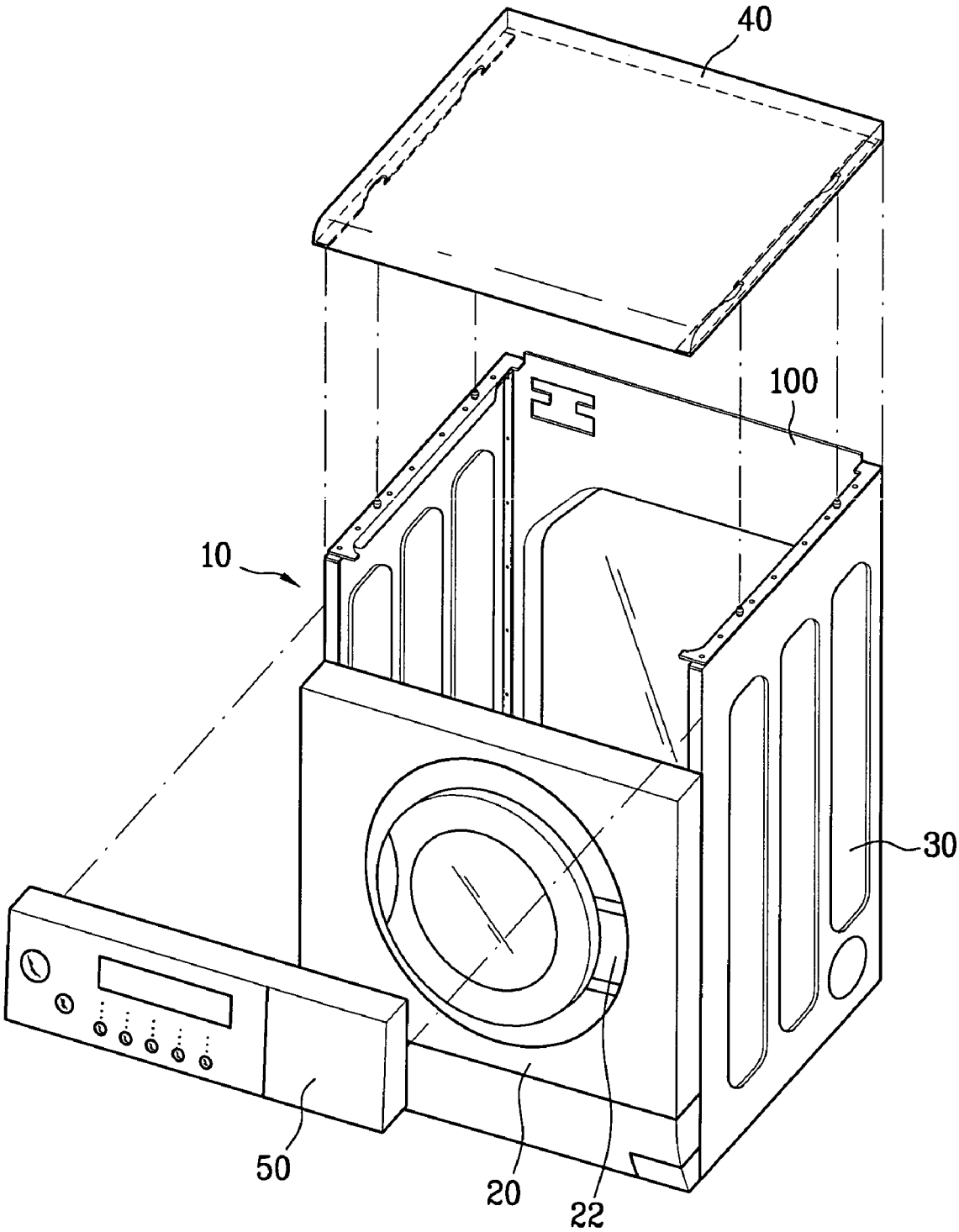
FIG. 1 is a perspective view of a dryer according to a related art.

Meanwhile, a front supporter (not shown) includes a circular projected part, which is similar to that of the rear supporter 70, corresponding to a front rim of the drum 60 to be coupled to a front side of the drum 60. The front supporter is fixed to a front cabinet ('20' in FIG. 1) as well as supports the front side of the drum 60. And, openings are formed on central parts of the front support and cabinet, respectively, so that an object to be dried can put in the dryer.

A stepping part 100*a*, as shown in FIG. 2, is provided to the back cover 100 to be recessed backward. In assembling the rear supporter 70 to the back cover 100, a lower end portion of the rear supporter 70 is preferentially fitted in the stepping part 100*a* and screws are then fastened via the locking holes 75 and 75*a* provided to the rear supporter 70 and back cover 100. In doing so, if a worker releases his hand(s) from the rear supporter 70 of which lower end is being supported only, the rear supporter 70 naturally falls forward to interrupt the alignment between the rear supporter 70 and the back cover 100.

In order to solve the problem, a dryer according to an embodiment of the present invention is explained as follows.

Figure 3:
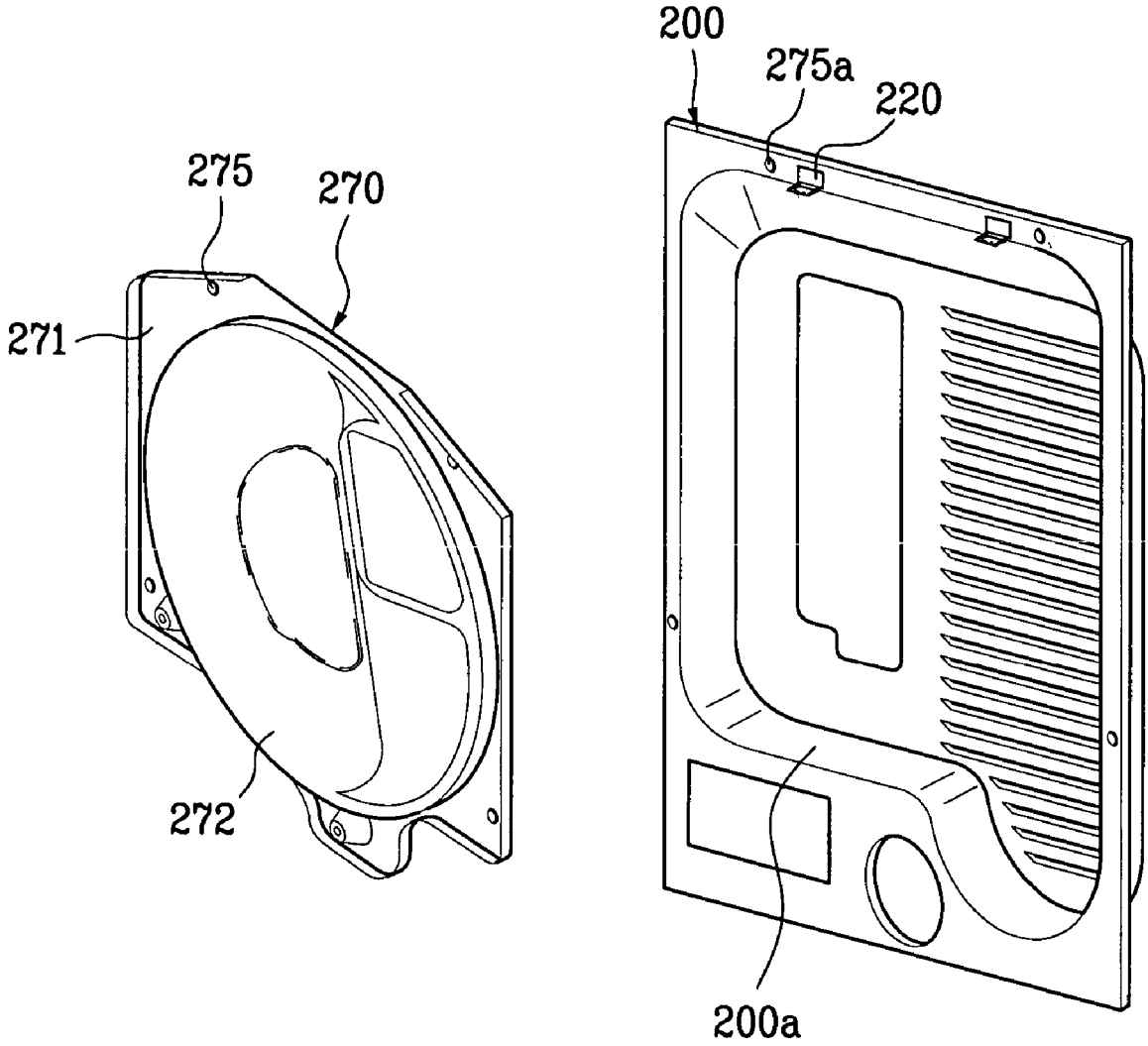
FIG. 3 is a perspective view of an assembly of a back cover and rear supporter of a dryer according to the present invention.
Figure 4:
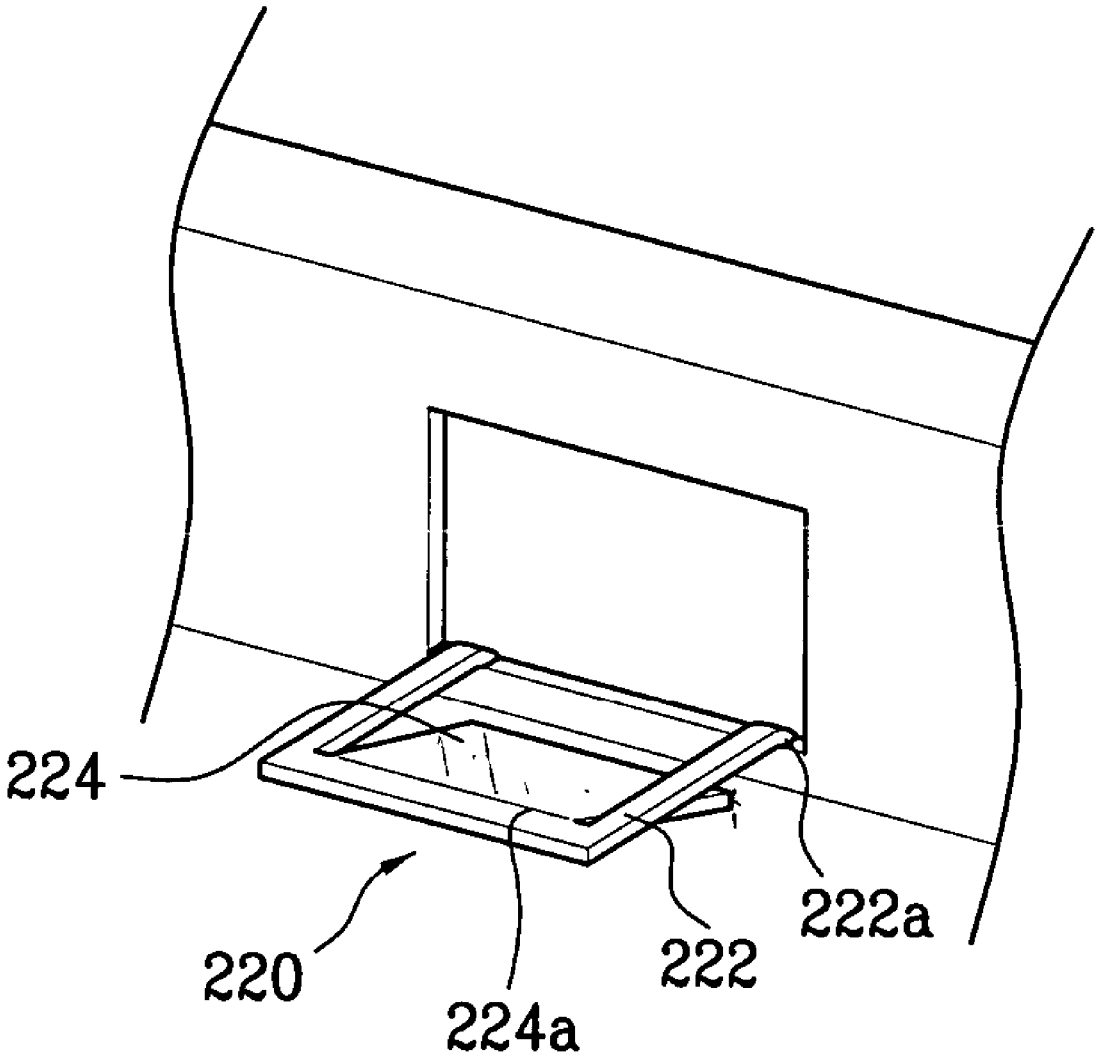
FIG. 4 is a magnified view of a latching part provided to one side of a back cover according to the present invention.

FIG. 3 is a perspective view of an assembly of a back cover and rear supporter of a dryer according to the present invention, and FIG. 4 is a magnified view of a latching part provided to one side of a back cover according to the present invention.

Referring to FIG. 3, a projected part 272 is provided to a front side of a rear supporter 270 to be inserted in a rear end of a drum. And, the rear supporter is fixed to a back cover 200 and supports the drum. An assembly between the rear supporter 270 and the back cover 200 includes a stepping part 200*a* and a latching part 220. In this case, a lower end portion of the rear supporter 270 becomes supported by the stepping part 200*a*. The stepping part 200*a* may be projected toward from the back cover 200*a* or may be formed on a lower side of a recess provided to the back cover 200.

Referring to FIG. 3, a recess, in which the rear supporter 270 will be inserted, is provided to a front side of the back cover 200. And, the stepping part 200*a* is provided to a lower side of the recess. And, an upper edge of the rear supporter 270 is fixed via the latching part 220 provided to an upper side of the back cover 200.

The latching part 220 is provided to the upper side of the back cover so that a height of the latching part 220 corresponds to that of the upper edge of the rear supporter 270. Namely, the latching part 220 is provided to a position corresponding to the height of the upper edge of the rear supporter 270, which is being supported by the stepping part 200*a*.

Specifically, the rear supporter 270 includes a support plate 271 and a projected part 272. The projected part 272 is projected toward from the support plate 271 to be inserted in a rear end of the drum. In this case, a lower end of the support plate 271 is supported by the stepping part 200*a* and an upper end of the support plate 271 is fixed via the latching part 220.

A method of forming the latching part 220 is explained as follows.

Referring to FIG. 4, one side of an upper end of the back cover 200 is cut to have a channel shape, thereby forming a first tab 222. An inner side of the first tab 222 is cut again to have a reverse channel shape, thereby forming a second tab 224. In doing so, the second tab 224 is cut to leave a predetermined distance from a cutting face of the first tab 222.

In doing so, the tabs 222 and 224 are formed by 'lancing'. 'Lancing' is performed in a manner of cutting a portion of a basic plate so that one side of the cut portion is left to be connected to the basic plate.

After the first tab 222 has been bent forward, the second tab 224 is bent downward by a predetermined angle. In order to guide a correct bending of each of the tabs, guide grooves 222*a* and 224*a* are formed on the bent portions of the first and second tabs 222 and 224, respectively.

Meanwhile, the present invention further enables to change a direction of the channel shape instead of putting limitation of the above-explanation. Namely, the first tab is cut from an upper side of the back cover 200 to have a reverse channel shape and the second tab is cut to have a channel shape. In doing so, the first tab is bent upward, while the second tab is bent upward to latch the upper edge of the rear supporter 270.

A process of assembling a rear supporter and back cover of a dryer according to the present invention is explained as follows.

In assembling the rear supporter 270 to the back cover 200, a lower end portion of the rear supporter 270 is supported by the stepping part 200*a* of the back cover 200. Locking holes 275 and 275*a* formed at the rear supporter 270 and back cover 200, respectively, are aligned to each other. The upper edge of the rear supporter 270 is then coupled to the latching part (piece) 220 provided to the upper side of the back cover 200.

In doing so, the upper edge of the rear supporter 270 is locked (or latched) by a tip of the second tab 224 provided inside the latching part 220. As the latching part 220 has elasticity, a restoring force of elastic distortion makes the second tab 224 latch the upper edge of the rear supporter 270.

Hence, the rear supporter 270 is temporarily fixed to the back cover 200, thereby being prevented from falling on locking screws and facilitating a worker to fasten the screws in the locking holes 275 and 275*a* at the rear supporter and back cover 270 and 200, respectively.

Accordingly, the dryer according to the present invention has the following advantages of effects.

First of all, in assembling the dryer, the latching part provided to the upper side of the back cover fixes the upper edge of the rear supporter thereto, whereby it is able to prevent the rear supporter from falling forward due to its weight. Hence, the worker need not hold the rear supporter to be facilitated to fasten the screws since the alignment between the locking holes of the rear supporter and back cover is correctly maintained.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A dryer comprising:

a back cover covering a rear side of the dryer;

a drum which holds laundry where the drum rotates, thereby drying the laundry;

a rear supporter supporting a rear side of the drum; and at least one latching part formed at an upper side of the back cover, the at least one latching part including a first tab having an elastic restoring force to latch the latching part to an upper edge of the rear supporter, and a second tab cut out from a portion of the back cover, wherein the first tab is cut out from a portion of the second tab.

2. The dryer of claim 1, wherein the latching part comprises:

the second tab cut out from one side of the back cover to have a channel shape and being bent forward, wherein the first tab is cut out from the portion of the second tab to have a reverse channel shape, the first tab being bent downward to latch the upper edge of the rear supporter.

3. The dryer of claim 2, wherein guide grooves are formed on portions where the first and second tabs are bent, respectively, to guide bending thereon.

4. The dryer of claim 2, wherein the first and second tabs are formed by lancing a portion of the back cover.

5. The dryer of claim 1, wherein the latching part comprises:

the second tab cut out from one side of the back cover to have a reverse channel shape and being bent forward, wherein the first tab is cut out from the portion of the second tab such that the first tab has a channel shape, the first tab being bent upward to latch the upper edge of the rear supporter.

6. The dryer of claim 5, wherein guide grooves are formed on portions where the first and second tabs are bent, respectively, to guide bending thereon.

7. The dryer of claim 5, wherein the first and second tabs are formed by lancing a portion of the back cover.

8. The dryer of claim 1, wherein a stepping part is provided to the back cover to support a lower end portion of the rear supporter.

9. The dryer of claim 1, wherein a recess recessed backward is provided to the back cover to have the rear supporter inserted therein.

10. The dryer of claim 1, wherein the at least one latching part comprises two or more equally-shaped latching parts.

11. A dryer comprising:

a drum which holds laundry and rotates, thereby drying the laundry;

a rear supporter supporting a rear side of the drum; and a back cover covering a rear side of the dryer, comprising:

at least one latching part formed at an upper side of the back cover, the at least one latching part including a first tab having an elastic restoring force to latch the latching part to an upper edge of the rear supporter, and a second tab cut out from a portion of the back cover, the first tab being cut out from a portion of the second tab; and a stepping part at a lower side of the back cover to support a lower end portion of the rear supporter.

12. The dryer of claim 11, wherein the latching part comprises:

the second tab cut out from one side of the back cover to have channel shape and being bent forward, wherein the first tab is cut out from the portion of the second tab such that the first tab has a reverse channel shape, the first tab being bent downward to latch the upper edge of the rear supporter.

13. The dryer of claim 12, wherein guide grooves are formed on portions where the first and second tabs are bent, respectively, to guide bending thereon.

14. The dryer of claim 12, wherein the first and second tabs are formed by lancing a portion of the back cover.

15. The dryer of claim 11, wherein the latching part comprises:

the second tab cut out from one side of the back cover to have a reverse channel shape and being bent forward, wherein the first tab is cut out from the portion of the second tab such that the first tab has a channel shape, the first tab being bent upward to latch the upper edge of the rear supporter.

16. The dryer of claim 15, wherein guide grooves are formed on portions where the first and second tabs are bent, respectively, to guide bending thereon.

17. The dryer of claim 15, wherein the first and second tabs are formed by lancing a portion of the back cover.

18. The dryer of claim 11, wherein a recess recessed backward is provided to the back cover to have the rear supporter inserted therein.

19. The dryer of claim 11, wherein the at least one latching part comprises two or more equally-shaped latching parts.

20. A dryer comprising:

a drum containing a laundry and rotating to dry the laundry;

a rear supporter supporting a rear side of the drum comprising:

a support plate; and a projected part projecting from the support plate to be inserted in a rear end of the drum and supporting a rim at the rear end of the drum; and a back cover covering a rear side of the dryer and comprising a latching part, the latching part comprising:

a first tab cut out from one side of the back cover to have a channel shape and being bent forward; and a second tab cut out from a portion of the first tab such that the second tab has a reverse channel shape and being bent downward to latch an upper edge of the rear supporter, wherein the second tab has an elastic restoring force which allows latching of the latching part to the upper edge of the rear supporter.

21. The dryer according to claim 20, further comprising a stepping part that is provided to the back cover to support a lower end portion of the rear supporter.

22. The dryer according to claim 20, further comprising a recess recessed backward that is provided to the back cover to have the rear supporter inserted therein.

23. The dryer according to claim 20, wherein the projected part has a circular shape to fit into the rear end of the drum.

24. The dryer according to claim 20, wherein the drum has an opened rear end.

25. The dryer of claim 1, wherein the rear supporter includes:

a support plate; and a projected part projecting from the support plate to be inserted into a rear end of the drum, and supporting a rim at the rear end of the drum.

26. The dryer of claim 25, wherein the projected part has a circular shape to fit into the rear end of the drum.

27. The dryer of claim 1, wherein the drum has an opened rear end.

28. The dryer of claim 11, wherein the rear supporter includes:

a support plate; and a projected part projecting from the support plate to be inserted into a rear end of the drum, and supporting a rim at the rear end of the drum.

29. The dryer of claim 28, wherein the projected part has a circular shape to fit into the rear end of the drum.

30. The dryer of claim 11, wherein the drum has an opened rear end.

* * * * *